US007866922B2

(12) United States Patent
Melegari

(10) Patent No.: US 7,866,922 B2
(45) Date of Patent: Jan. 11, 2011

(54) EQUIPMENT AND METHOD FOR CONSTRUCTING MICROPILES IN SOIL, IN PARTICULAR FOR THE ANCHORAGE OF ACTIVE ANCHORS

(76) Inventor: Cesare Melegari, Via Boschi 25, Noceto (PR) (IT) 43015

( * ) Notice: Subject to any disclaimer, the term of this patent is extended or adjusted under 35 U.S.C. 154(b) by 219 days.

(21) Appl. No.: 11/808,167

(22) Filed: Jun. 7, 2007

(65) Prior Publication Data

US 2008/0193225 A1 Aug. 14, 2008

(30) Foreign Application Priority Data

Feb. 14, 2007 (IT) ..... PC2007A0010

(51) Int. Cl.
*E02D 7/00* (2006.01)

(52) U.S. Cl. ..... 405/232; 405/231; 405/233; 405/239; 405/244

(58) Field of Classification Search ..... 405/229, 405/230, 231, 232, 233, 236, 237, 239, 240, 405/241, 244, 259.1, 259.5, 269; 175/67, 175/171

See application file for complete search history.

(56) References Cited

U.S. PATENT DOCUMENTS 3,420,320 A * 1/1969 Washita ..... 175/161
3,682,256 A * 8/1972 Stuart ..... 175/40
3,742,717 A * 7/1973 Wey ..... 405/238
3,844,362 A * 10/1974 Elbert et al. ..... 175/94
4,199,011 A * 4/1980 Kreft et al. ..... 138/157
4,938,193 A * 7/1990 Raufeisen et al. ..... 123/470
5,575,593 A * 11/1996 Raaf ..... 405/237
5,868,523 A * 2/1999 Nickell et al. ..... 405/128.45
5,901,798 A * 5/1999 Herrera et al. ..... 175/325.3
5,919,005 A * 7/1999 Rupiper ..... 405/244
6,120,214 A * 9/2000 Iovino ..... 405/241

* cited by examiner

*Primary Examiner*—David J Bagnell
*Assistant Examiner*—Benjamin Fiorello
(74) *Attorney, Agent, or Firm*—Young & Thompson

(57) ABSTRACT

An equipment for constructing micropiles in soil, includes a drilling rod with a bit with at least one nozzle jetting fluid forward, and at least one nozzle jetting fluid substantially orthogonal; an element pulling a protective tube, not adhering to the rod. A corresponding method includes drilling with a drilling rod jetting liquid in front of the bit until reaching stable soil strata; drilling and injecting high-pressure grout with one or more lateral nozzles, while the drilling rod rotates; pulling the protective tube, the tube being inserted to the area of grout injection; when the required depth is reached, the proximal end of the drilling rod is anchored to a plate; when the grout is consolidated, traction is applied to the drilling rod if necessary. Grout is injected into the protective tube.

7 Claims, 3 Drawing Sheets

EQUIPMENT AND METHOD FOR CONSTRUCTING MICROPILES IN SOIL, IN PARTICULAR FOR THE ANCHORAGE OF ACTIVE ANCHORS

This is a U.S. non-provisional application that has been filed under 37 CFR 1.53(b) and claims priority to Italian patent application No. PC 2007A 000010, filed Feb. 14, 2007. The entire contents of the above-referenced application is hereby incorporated by reference in its entirety.

BACKGROUND OF THE INVENTION

This invention relates to equipment and the corresponding method for constructing concrete micropiles of the type used for soil consolidation, underpinning and the like, or for the anchorage of tie-rods, especially active anchors.

The equipment according to the invention includes a disposable drilling rod fitted at the tip with a bit equipped with two or more nozzles for the injection of a liquid at high pressure; and means designed to pull a tubular protective element, not adhering to the drilling rod, together with said rod during drilling.

In detail, the invention involves fitting to the drilling rod a conical sleeve with one threaded end for connection to the tubular protective element, which said conical sleeve is fitted to the rod in such a way that it can rotate, stop means which prevent it from traversing being fitted, so that the drilling rod can rotate freely and pull said sleeve into the ground during drilling.

The invention also relates to a method of constructing micropiles which involves drilling with a disposable drilling rod that pulls a protective tube, which does not adhere to the drilling rod, with said rod during drilling; when the area of stable soil is reached, drilling continues, and a mixture of water and cement is simultaneously injected into the soil while the drilling rod descends and rotates; after drilling, the proximal end of the drilling rod is anchored to a plate and traction is applied if necessary.

The method according to the invention not only enables micropiles to be constructed in a short time, with a considerable saving on the cost of the finished product, but also allows the construction of active anchors, namely tie-rods to which traction can be applied after they have been laid. One of the most effective methods of stabilising soil or slopes, or increasing the load-bearing capacity of soil, is the construction of micropiles, a technique that involves making reinforced concrete piles of suitable size in the soil in order to stabilise the soil and increase its ability to bear loads.

In accordance with known techniques, these piles are constructed by drilling a hole in the ground with a drilling rod fitted with a bit at the tip, inserting steel reinforcement in the hole, and filling it with concrete.

This is a rather laborious technique, which involves long working times and correspondingly high costs.

In recent years a new technique has been developed, described in European patent application no. 1,719,841 by the same applicant, which involves drilling with a rod that acts as reinforcement for the pile and injecting grout directly during drilling; this means injecting downwards from the surface, unlike the earlier methods, in which the grouting stage was performed upwards, from the bottom of the hole to the surface.

SUMMARY OF THE INVENTION

The present invention, which falls into this sector, relates to equipment and the corresponding method for constructing micropiles, in particular for the anchorage of active anchors, which further improves said prior art.

In particular, the method and equipment according to the invention allow the micropile to be constructed at a given depth, so that only the areas of stable ground, situated at a certain depth, bear the load.

For this purpose, the invention involves the use of drilling equipment consisting of a drilling rod fitted with a bit at the tip and nozzles for the injection of high-pressure grout into the soil, said rod being fitted with means designed to pull a protective tubular sheath into the soil during excavations.

Said system allows the drilling rod to be inserted to the required depth, followed by grout injection to construct the pile in stable soil; when the grout has been consolidated, the drilling rod is anchored on the surface and traction is applied with techniques similar to pre-stressing techniques. The presence of the tubular sheath not only allows traction to be applied to the rod that constitutes the reinforcement, but also effectively protects it against corrosion.

BRIEF DESCRIPTION OF THE DRAWINGS

This invention will now be described in detail, by way of example but not of limitation, by reference to the annexed figures wherein.

DETAILED DESCRIPTION OF THE INVENTION

Figure 1:
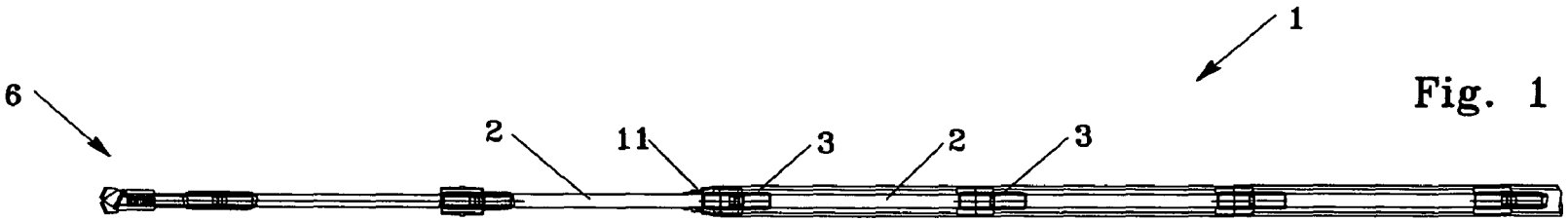
FIG. 1 illustrates a drilling rod according to the invention, in cross-section.
Figure 2:
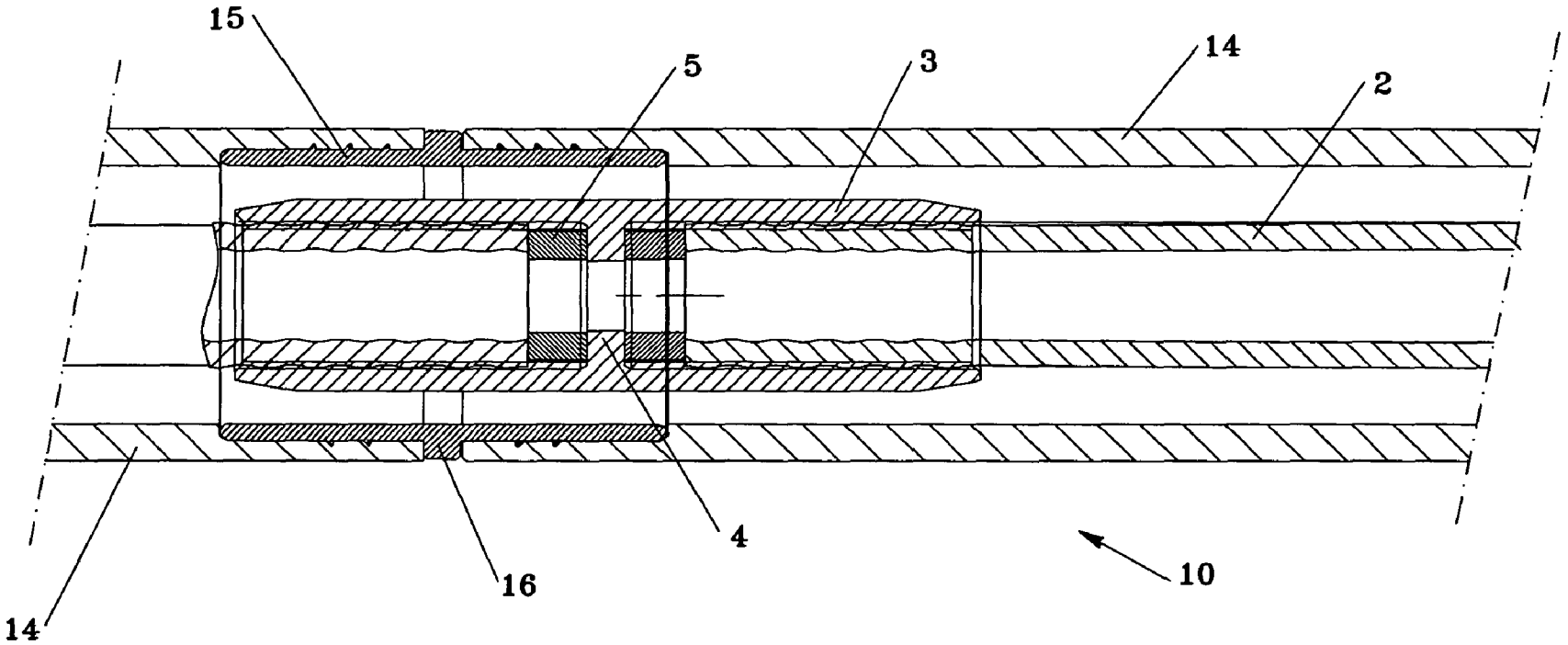
FIGS. 2 and 3 illustrate two details of the drilling rod shown in FIG. 1, again in cross-section.

In FIG. 1, no. 1 indicates a drilling rod assembly according to the invention, consisting of a series of steel bars 2, of known type, which are connected end to end via threaded sleeve couplings 3, which present an abutment 4 in the centre against which the head ends of the bars rest, with the interposition of a seal 5.

In accordance with an advantageous characteristic of the invention, said seals are made of metal, in particular aluminium.

Drilling rod 1 is hollow and fitted at the head with a bit 6 that presents two or more nozzles 7 and 8, which communicate with axial tube 9 present inside the drilling rod, which in turn communicates with systems designed to convey a high-pressure fluid along the drilling rod.

One or more of nozzles (7) directs a jet of water into the area in front of the bit, to disintegrate the soil and aid penetration, while the other nozzles (8) are directed perpendicular to the rod and inject a mixture of water and cement at high pressure to form a concrete column or pile in the soil as the rod advances, rotating.

The rod is preferably galvanised, to provide greater protection against corrosion over time.

A characteristic feature of the invention is that it includes means designed to pull a protective tube 10 made of plastic, such as polyethylene, into the ground as the drilling rod advances.

Said means consist of a cone-frustum-shaped sleeve 11 which is fitted over the rod, the end of said sleeve with the larger diameter being threaded for connection, either directly or via a threaded tubular connector 12, to tubular sheath 10.

Figure 3:
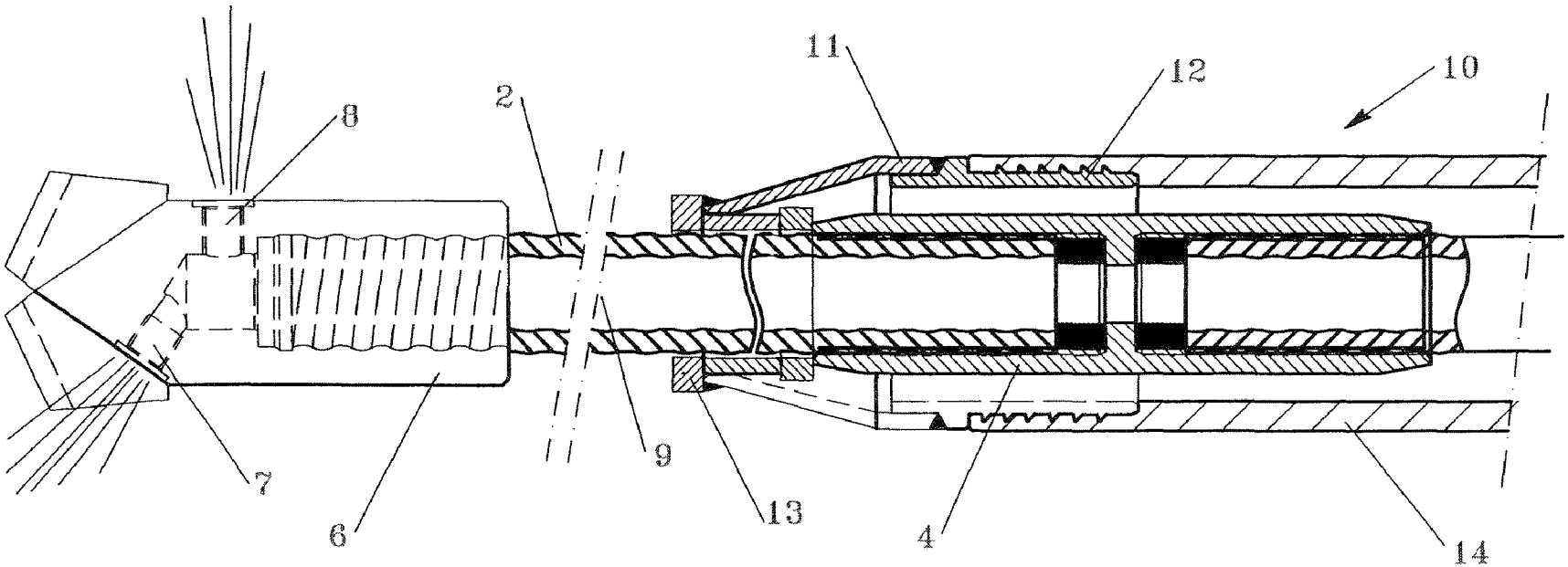

The front end of sleeve 11, shown as no. 13 in FIG. 3, is mounted loose on the drilling rod, so that it can rotate freely in relation thereto.

However, traverses of sleeve 11 along the drilling rod axis are prevented by stop means, which can be formed directly by one of connectors 4 that join the various drilling rod sections, or by a ring screwed onto said rod. In this way the drilling rod can rotate freely in relation to the tubular sheath, which is pulled into the ground by the advancing rod.

Protective sheath 10 also consists of various sections shown as 14, joined by threaded metal sleeves 15 which always have an annular abutment 16 in the central area that acts as stop means.

Tubular plastic sheath 10, together with the galvanising treatment of the drilling rod, guarantees effective protection against corrosion, and the equipment described complies with the specifications imposed by the legislation for anchors classed as permanent.

Figure 4:
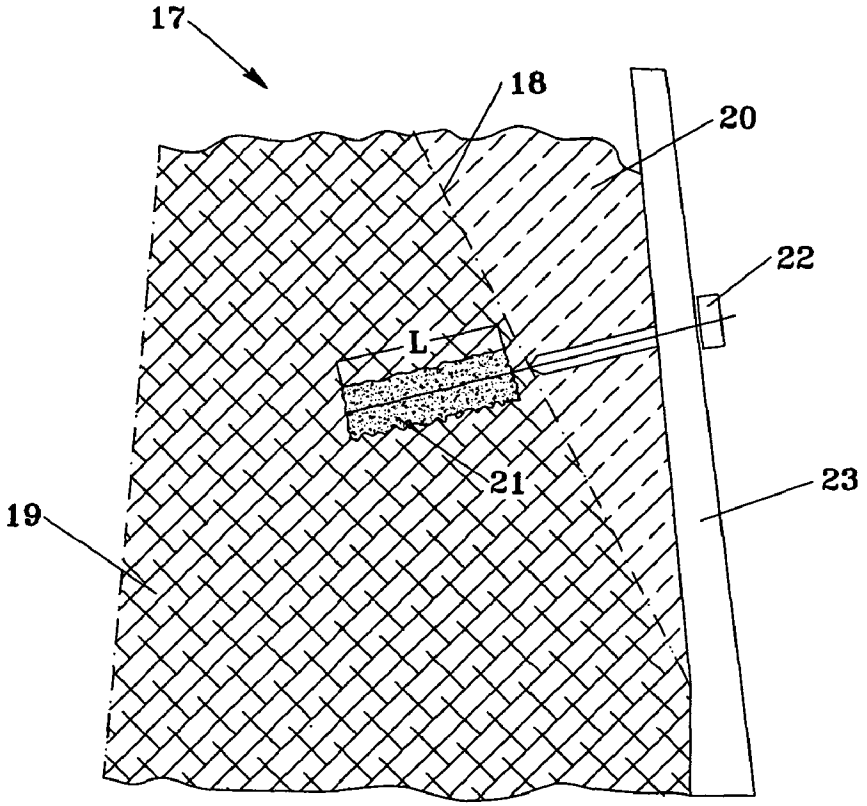
FIG. 4 schematically illustrates a possible application of the equipment and method according to the invention.

FIG. 4 schematically illustrates the method of constructing the active anchors according to the invention.

In this figure, no. 17 indicates a block of soil to be stabilised and 18 identifies the angle of friction that separates zone 19 of stable, compact soil from a zone 20, consisting of loose soil.

The method according to the invention involves the use of the equipment described above, wherein sleeve 11 is positioned at a distance from the bit which is substantially equal to length "L" of the piles to be constructed in the soil.

The method requires drilling to begin with the injection, through nozzles 7, only of the amount of water required to disintegrate the soil and facilitate the advance of the bit.

When the bit goes beyond line 18 and starts to drill in the area of compact soil, injection of high-pressure grout also begins, so as to form a concrete pile 21 that surrounds the drilling rod in the layer of compact soil.

When the required depth is reached, the situation will be as illustrated in FIG. 4, with a cement pile anchored in the solid ground, and the drilling rod protected by grout in this first section and by tubular sheath 10 in the section upstream of sleeve 11, which extends through the whole area of loose soil.

The proximal end of the rod can be anchored to a plate 22, which in turn is fixed to a load-spreading beam or the like 23.

When the cement has been consolidated, traction can be applied to the drilling rod with the usual pre-stressing techniques, and the pile is completed by injecting grout into tubular sheath 10, to provide greater protection over time.

The invention claimed is:

1. Equipment for constructing micropiles in soil, including:

a hollow drilling rod (2) comprised of a number of elements (2) joined to each other, is fitted at the head with a bit (6), and is adapted, by rotating, to drive the rotation of said bit (6) wherein said bit presents at least one nozzle (7) adapted to direct a jet of fluid in front of the bit, and at least one nozzle (8) adapted to direct a jet of fluid in a direction substantially orthogonal to the axis of the drilling rod;

pulling means (11, 12) adapted to pull a protective tube (10), comprising of various sections (14) joined to each other, for the elements (2) of said drilling rod (2), while the rod advances, rotating, through the soil, said pulling means being configured so that said protective tube (10) does not interfere with the rotation of said drilling rod, wherein said pulling means consist of a sleeve (11), for the connection of said protective tube (10), which is fitted on the drilling rod (2) and is configured to allow free rotation of it, is fitted with coupling means (12) for said protective tube (10), and is fitted with stop means adapted to prevent said connector (11) from traversing along said drilling rod (2), while it advances through the soil.

2. The equipment as claimed in claim 1, wherein said connector for the connection of said protective tube (10) comprises a metal cone-frustum-shaped sleeve (11) which presents a thread for connection to said protective tube (10) on one side and, on the opposite side, a sleeve (13) whose inner diameter is slightly larger than the outer diameter of the drilling rod (2).

3. The equipment as claimed in claim 2, wherein said stop means adapted to prevent the axial traverse of said sleeve (11) during drilling consist of a ring attached to said drilling rod.

4. The equipment as claimed in claim 2, wherein said stop means consist of sleeve couplings (3) between the various parts of the drilling rod (2).

5. The equipment as claimed in claim 2, wherein said elements (2), of said drilling rod (2), are joined by connectors constituted by threaded sleeves (3) which present an abutment (4) adapted to act as stop means in the central area, metal seals (5) being fitted between the heads of the drilling rod elements (2) and said abutment (4).

6. The equipment as claimed in claim 5, wherein said seals (5) are made of aluminium.

7. The equipment as claimed in claim 6, wherein said drilling rod is galvanised.

* * * * *